United States Patent [19]

Awata et al.

[11] Patent Number: 4,622,448

[45] Date of Patent: Nov. 11, 1986

[54] MICROWAVE VACUUM DRYER APPARATUS

[75] Inventors: Hidenori Awata, Takarazuka; Shusaku Shimada, Nabari; Morio Kikuchi, Hiratsuka; Kenichi Abe, Omiya, all of Japan

[73] Assignees: Osaka Gas Company, Limited; Kabushiki Kaisha Sofard, both of Japan

[21] Appl. No.: 758,040

[22] Filed: Jul. 23, 1985

Related U.S. Application Data

[63] Continuation of Ser. No. 518,305, Jul. 11, 1983, abandoned.

[30] Foreign Application Priority Data

Feb. 19, 1982 [JP] Japan ..... 57-024519

[51] Int. Cl.[4] ..... H05B 6/72

[52] U.S. Cl. ..... 219/10.55 A; 219/10.55 F; 219/10.55 M; 34/1

[58] Field of Search ..... 219/10.55 A, 10.55 F, 219/10.55 R, 10.55 E; 34/1

[56] References Cited

U.S. PATENT DOCUMENTS

| | | | |
|---|---|---|---|
| 3,276,138 | 10/1966 | Fritz | 219/10.55 R |
| 4,160,145 | 7/1979 | Rueggeberg | 219/10.55 F |
| 4,310,739 | 1/1982 | Hatem | 219/10.55 A |
| 4,330,946 | 5/1982 | Courneya | 219/10.55 R X |
| 4,332,091 | 6/1982 | Bensussan et al. | 219/10.55 F X |
| 4,400,604 | 8/1983 | Ohtsuka et al. | 219/10.55 A X |
| 4,435,629 | 3/1984 | Ishimaru et al. | 219/10.55 A |

*Primary Examiner*—Philip H. Leung

*Attorney, Agent, or Firm*—Kane, Dalsimer, Kane, Sullivan and Kurucz

[57] ABSTRACT

Slot-array antennas are connected by waveguides (14, 15, 16, 17) to microwave generators and are disposed within a vacuum drying tank of a drying apparatus. Blocking plates (23) are mounted in the waveguides so as to keep the waveguides airtight thereby maintaining an atmospheric pressure within the waveguide portions near the microwave generator during operation of the apparatus. The slot-array antennas (19, 20, 21, 22) have heat pipes (27) attached to the sides of said antennas so that a heat radiation may be effected simultaneously with the microwave heating.

7 Claims, 8 Drawing Figures

MICROWAVE VACUUM DRYER APPARATUS

This is a continuation of U.S. Ser. No. 518,305, filed 7-11-83, now abandoned.

TECHNICAL FIELD

This invention relates to a vacuum freeze dryer apparatus or a vacuum dryer aparatus, equipped with microwave heater apparatuses.

As is well known, it is possible by freeze-drying foods and the like to obtain dried products which are in no substantial degree inferior as to their color, flavor, taste and vitamins in comparison with those in the raw materials, and yet further it is possible, by adding water or hot water to the dried products, to restore same substantially completely to the state that was observed prior to the drying.

However, in the case of freeze-drying the foods and the like, there has been a drawback in that it requires long time to dry same to the predetermined state when only the conventional method either of radiator heating or conduction heating, is utilized, and in consequence thereof that the drying cost gets very high.

For shortening the drying time, we have previously proposed a drying method in which a combined heating system is designed to include a microwave heating as shown in JP-A SHO. No. 56-23879, and a heating apparatus for the combined heating as shown in JP-A SHO. No. 56-22086.

In the case of freeze-drying the foods and the like, generally prevailing is the drying under reduced pressure, thus the so-called vacuum drying, and also known is the fact that it is important in order to accelerate the drying rate under reduced pressure to improve a heat transmission to the goods to be dried. Such a good heat transmission will also be important in case of microwave heating. On the other hand, when the freeze-drying apparatuses on the industrial scale is required to handle a large amount of the foods and the like, it is imperative to inject a high microwave energy necessary and sufficient to the great treating amount, the high energy thereby causing the following problem to take place.

When gradually heightening the output level of microwaves radiated into a field of free space under a reduced pressure, the insulation of a gas at the location where the electric field is strong will be broken to thus induce microwave discharge at such location so that the heating energy is accordingly consumed without avail, it has therefore not been able to effect efficient microwave heating even by raising up the power injected.

The above problem will be explained more in detail hereinafter. The intensity of electrical field for initiation of electric discharge in case of where the microwaves are emitted in a free space under a reduced pressure varies according to the kind of the gas existing in the free space, oscillation-exciting frequency of the microwaves and so forth. Said intensity varies in a typical manner in its relationship particularly with the pressure. FIG. 1 shows a correlative relationship between the pressure and the electrical field intensity wherein the oscillation-exciting frequency of the microwaves is set at 2450 MHz, the gas within said space being a mixture of air and water vapor. Since the air or water vapor in general the main ingredient of the gas within the sapce in the operation of the freeze-drying of the foods and the like, FIG. 1 serves as the basis for a design of the vacuum dryer apparatus or the vacuum freeze dryer apparatus provided with a microwave heater apparatus.

When the foods and the like are freeze-dyied, operation is generally carried out at a vacuum state of or below 200 Pa. This state is however the worst ambient condition, as seen from FIG. 1, because the discharge initiating intensity of electrical field is minimum, namely most likely to cause the electric discharge. However the known conventional apparatuses have never adopted such a structure of the microwave transmitting circuit that could be reasonable from the view of electric discharge property. Therefore, none of the known apparatuses has become to be used practically on a commercial base.

DISCLOSURE OF INVENTION

Thus, one object of this invention is to provide a dryer apparatus that has (a) slot-array antenna(s) within (a) vacuum drying tank(s), (a) waveguide(s) connecting said slot-array antenna(s) to (a) microwave generating apparatus(es), and (a) blocking plate(s) made of a material through which it is easy for the microwave to pass, the plate(s) being located at connecting portion(s) between the slot-array antenna(s) and waveguide(s) or the waveguide(s) per se near the connecting portion(s) to thereby seal up the waveguide interior. According to the invention the microwaves are transmitted to the slot-array antenna(s) or to a vicinity closest thereto under the atomospheric pressure or a pressure near the atmospheric pressure so that the electric field intensity for initiation of the electric discharge is improved to thereby make it more difficult for the microwave transmitting waveguides to electrically discharge whereby the necessary level of the microwave energy is maintained within the invented apparatus.

Further, if the blocking plate is formed with a window frame made of a metal and a window made of a material through which it is easy for the microwave to pass, then the blocking plate will constitute a closed type resonator apparatus integral with the slot-array antenna, and the loss of the microwaves passing through the blocking plate will be reduced.

BEST MODE FOR CARRYING OUT THE INVENTION

Details of this invention will be hereinafter described referring to the accompanying drawings.

Figure 1:
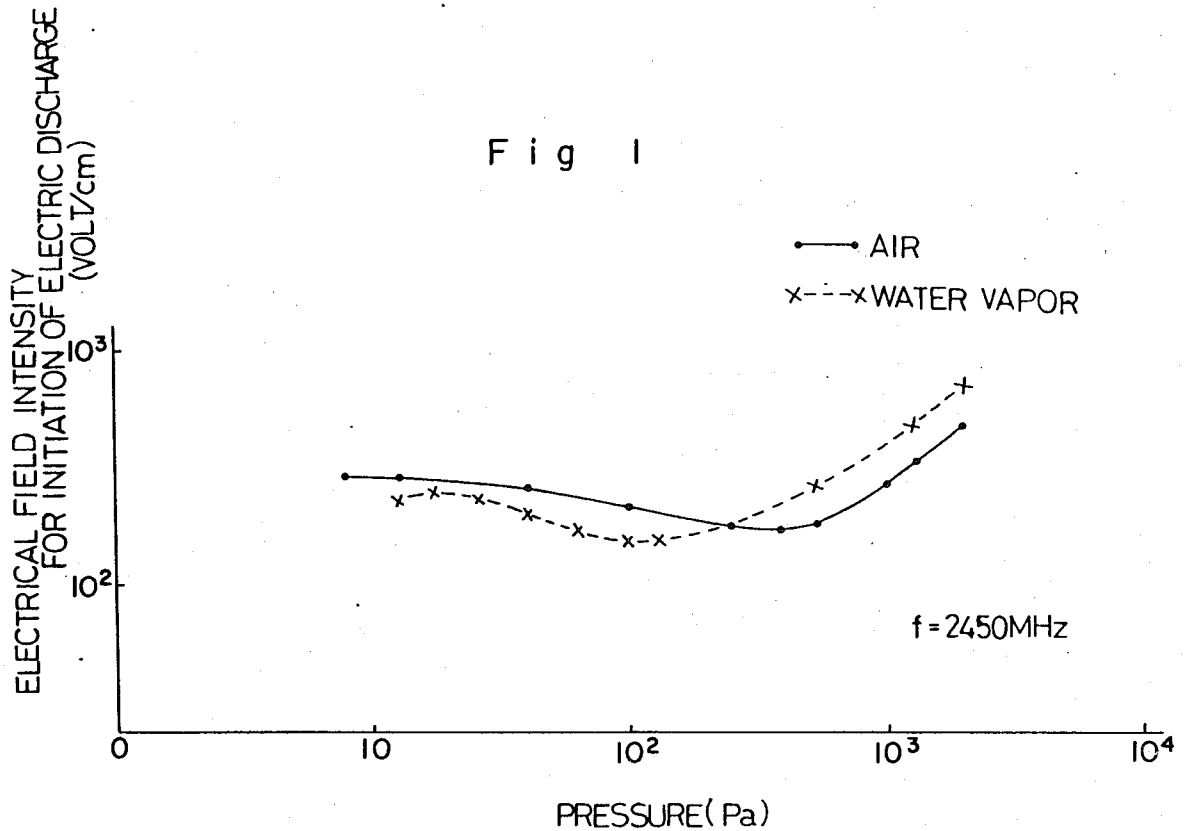
FIG. 1 is a graph showing the correlative relationship between pressure and electrical field intensity for initiation of electric discharge.
Figure 2:
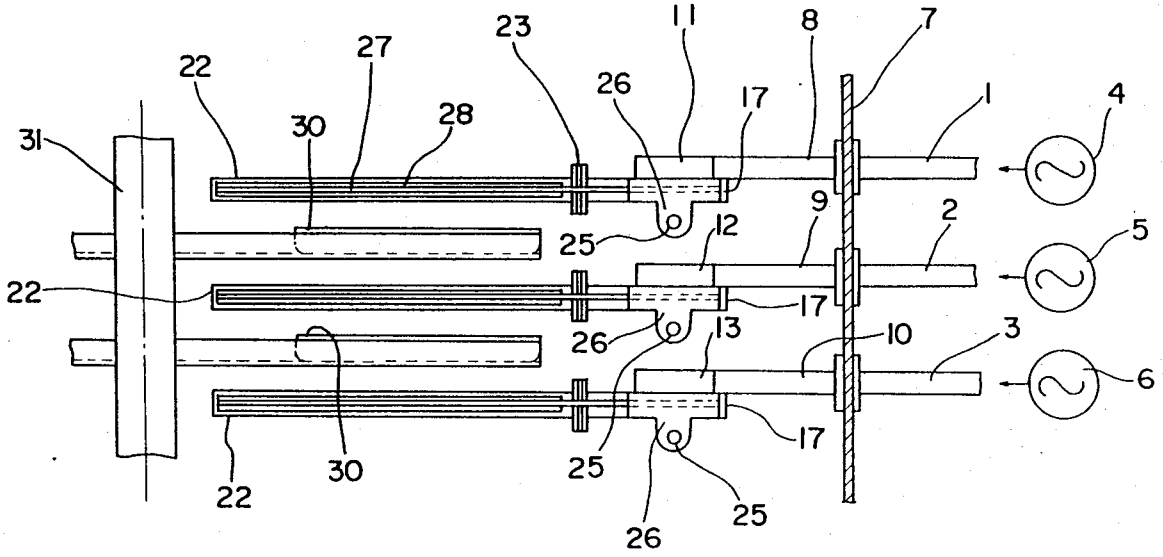
FIG. 2 is a front view of an embodiment of this invention with its portion shown in vertical section.
Figure 3:
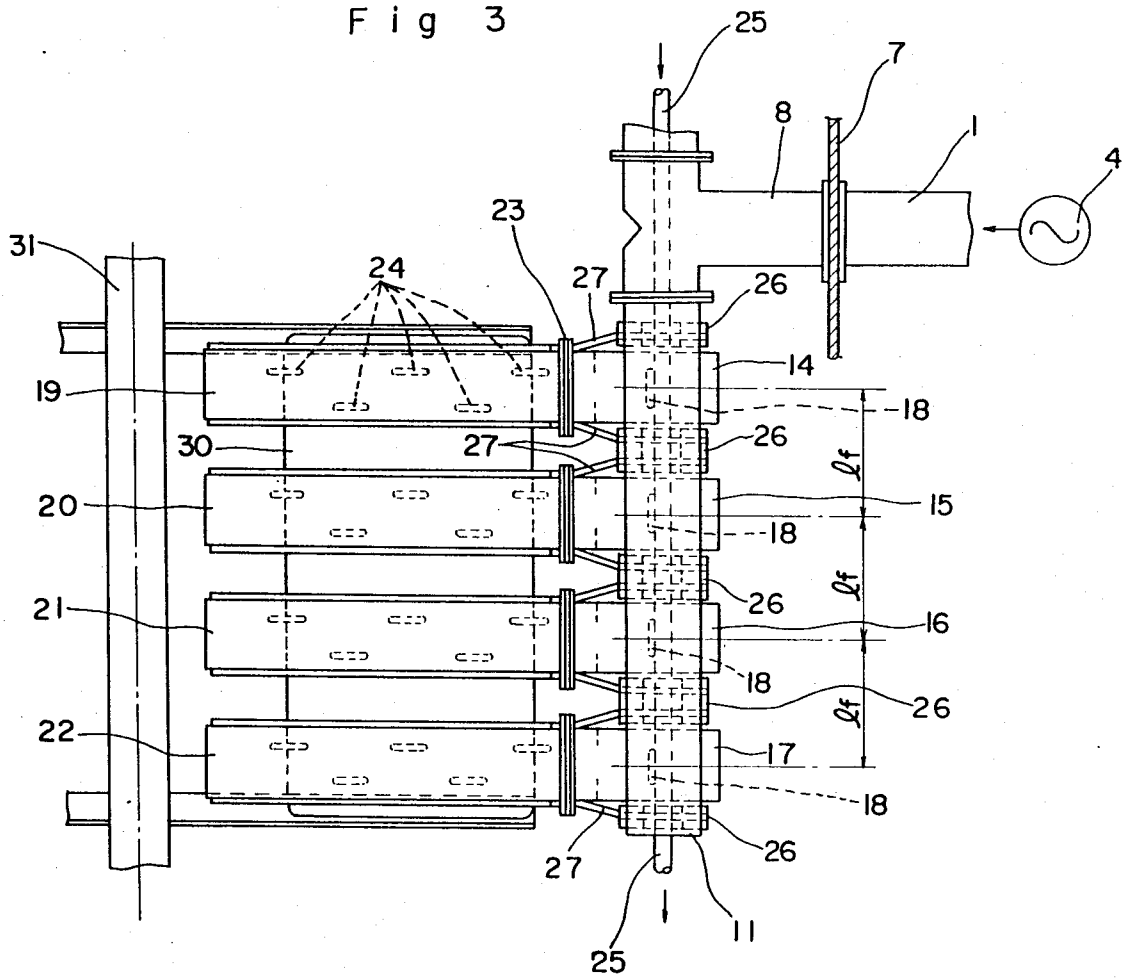
FIG. 3 is a plan view thereof.

A vertical section of an embodiment of this invention and a plan view thereof are respectively shown in FIGS. 2 and 3, in which there are provided main waveguides (1) to (3) outside a tank, the main waveguides consisting of rectangular waveguides to which are connected microwave oscillators (4) to (6) at the righthand ends and T-shaped branching waveguides (8) to piercing through the vacuum-dryer tank wall (7), and located within the tank at the lefthand ends.

To the outlet side of the respective T-shaped branching waveguides (8) to (10) within the tank, there are connected primary branching waveguides (11) to (13) respectively having their ends closed (short-circuited), and to each of the primary branching waveguides (11) to (13) there in turn are connected a plurality of, for instance four secondary branching waveguides (14) to (17), having their end portions overlapped each other. The secondary waveguides are arranged in configuration as comb-teeth at intervals $l_f$ equal to the wavelength of the transmitted waves within the guides. Slots (18) for connection are leading the microwaves from the primary branching waveguides to the secondary branching waveguides.

Figure 7:
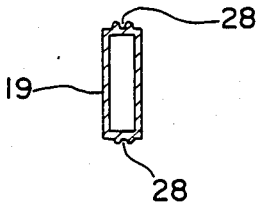
FIG. 7 is a sectional view per line A—A.

Slot-array antennas (19) to (22) are connected via blocking plates (23) to the secondary branching waveguides (14) to (17), respectively, with their sectional shape as shown in FIG. 7. Slots (24) for microwave radiation have the same shape and are arranged in configuration of steppingstones at regular intervals, on the lower surfaces of each slot-array antenna in the upper tier, on the upper surfaces of each slot-array antenna in the lower tier as well as on both the upper and lower surfaces of each slot-array antenna in the middle tier shown in FIG. 2. Thus, each of slot-array antenna in the upper tier and lower tier is a type of single-surface-radiation while each of slot-array antenna in the middle tier being a type of both-surface-radiation.

Figure 5:
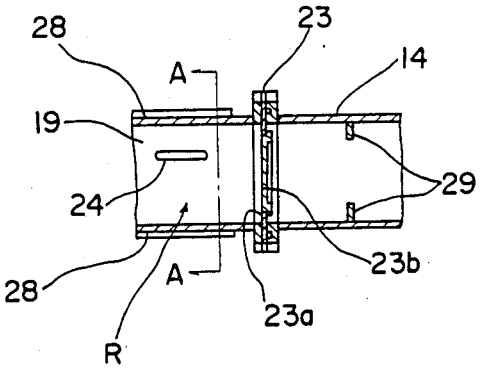
FIG. 5 is an enlarged sectional view of a connecting portion between the slot-array antenna and a waveguide.

Each of the blocking plates (23) is fixedly secured, as shown in FIG. 5, sandwiched between the secondary branching waveguides (14) and the slot-array antennas (19), and is formed with a window frame (23*a*) airtight to prevent any vacuum leakage as well as a window (23*b*) made of a material such as Teflon, ceramic, glass, quartz glass, borosilicate glass, polysulphone or the like. The windows have an induction characteristics to allow the microwaves to pass through them without resulting in a great energy loss. Since the borosilicate glass in particular is substantially of the same thermal expansion coefficient as that of Kovar metal, jointing fusion thereof will be easy when the window frame is made of Kovar metal.

Each of abovesaid blocking plates (23) thus constitutes a closed type resonator (R) integral with the slot-array antenna.

Circulation pipes (25) serve the transfer a heating medium and are disposed in parallel with the primary branching waveguides (11) to (13). Heat-transmission-relaying bodies (26) made of aluminum alloy, are casted on the outer surfaces of the pipes (25) in shape like skewered dumplings according to the separate gap spaces between the secondary branching waveguides.

Heat pipes (27) are fitted in protrusion grooves (28) (see FIG. 7) on both sides of the slot-array antennas, and secured by means of adhesive agent of good thermal conductivity. End portions of the heat pipes are inserted into holes provided in the heat-transmission-relaying bodies (26), and fixedly secured by means of adhesive agent of good thermal conductivity.

It may be possible to omit the heat-transmission-relaying bodies (26) so as to connect the heat-pipes directly to the circulation pipes for the heating medium.

By the way, the heat pipes referred to above may be such that the heating medium passes through the pipe interior, or heating medium is contained therein. Moreover, it is also possible to use solid rods or heater apparatuses such as electric heaters and the like, in place of the abovesaid heat-pipes.

Figure 6:
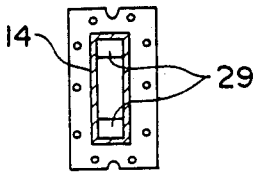
FIG. 6 is a righthand side elevation of FIG. 5.

As shown in FIG. 5 and FIG. 6, irises (29) (adaptor apparatuses for retroflexion of reflected microwaves) are provided in the secondary branching waveguides (14) for the purpose of retroflexion of the microwaves reflected from the slot-array antennas (19). Recipient trays (30) adapted to contain the foods or the like to be dried are held between the slot-array antennas located thereabove and therebeneath by means of a transferring-holder (31), in such locations as to scarcely cause hindrance against the radiation of the microwaves emitted by the slot-array antennas.

The recipient trays (30) are made of a material such as Teflon, polypropylene, polysulphone or the like, of small dielectric loss and small reflection coefficient.

Strength and junctions of the waveguides of the microwave transmitting circuit arranged within the vacuum-dryer tank are so carefully designed not to cause any vacuum leakage. The inlet-side end portions of the T-shaped branching waveguides (8) to (10) within the tank are mounted to the vacuum-dryer tank wall (7) by means of vacuum gaskets.

Though it is not illustrated in the drawings, both the microwave and radiation heating apparatuses shown in FIG. 2 and FIG. 3 are provided on the left and right sides symmetrically with regard to the axis of the transferring-holder (31), all of them being mounted in the vacuum-dryer tank.

Having given hereinabove the description on the structure of the embodiment, it is noted here that the primary characteristics of this embodiment resides in a fact that the interior of the waveguides on the side of the microwave oscillator can be maintained at a pressure higher than that within the microwave antennas which are under reduced pressure, preferably at the atmospheric pressure as in the ambodiment, by means of providing the blocking plates (23) intermediately of the waveguide circuit in the microwave heating apparatuses.

Besides, since the blocking plate (23) is formed to construct a close type resonator apparatus (R) together with the microwave antenna portion the microwaves are able to pass through this blocking plate at only a slight loss.

On the other hand, the microwave-transmitting circuit is designed as follows.

First, with regard to the minimum electrical field intensity $Vm \simeq 180$ Volts/cm for initiation of electric discharge, the microwave-transmitting circuit which comprises the waveguide circuit consisting of the main waveguides outside the tank, T-shaped branching waveguides, primary and secondary waveguides are so constructed that the electrical field intensity Vw at the inlet ends of the slot-array antennas (19) to (22) is smaller than the Vm, namely $Vw < Vm$.

By virtue of this, it is possible to unify the shape and size of the waveguides constituting all of the slot-array antennas while suppressing electric discharging all over the entire system of the slot-array antennas.

Besides dimensions and locations of the slots (24) for microwave radiation give influences to the directive characteristics of the microwaves radiated from the slots and the electric field intensity distribution of the radiated electric waves, said characteristic and distribution also have much to do with the electric field intensity prevailing at the locations of the slots. If electrical field intensity in regions near the slots becomes higher than that for initiation of electric discharge, then electric discharging will occur at such regions.

Accordingly, the dimensions, locations and number of the slots are designed so that the directivity of the radiated electric waves and the intensity distribution of the radiation field can be optimized by virtue of preferable relations between the juxtaposed slots from a point of view that these directivity and distribution characteristics are the imperative conditions for uniform heating and drying of the foods or the like stationarily placed over the wide range.

In view particularly of the directional characteristics of the wall surface current flowing in the pipe wall of the antenna, the slots are disposed alternately with respect to the axis of the antenna, and the distance between the centers of the alternate slots are made equal to a half of the wave-length $\lambda_g$ of the transmitted wave within the guide. Hence, all the electric currents flowing to the respective slots have the same phase, and it results in that the electric waves radiated from the slots in a direction normal to the pipe axis of the antenna.

Besides, the radiation impedance of the respective slots are made equal to each other by disposing them at the interval exactly equal to $\frac{1}{2}$ of the wave-length $\lambda_g$ of the transmitted wave within the guide.

Further, it is noted that each tip end of the slot-array antenna is short-circuited while making the distance from the tip end to the center line of the slot that is at the shortest distance therefrom, equal to $\frac{3}{4}$ of the wave-length $\lambda_g$ of the transmitted wave within the guide. Induction impedance of each is thus caused to be infinity ($\infty$) so that the feeble reflection waves as occurring at the short-circuit wall and the window frame (23*a*) of the blocking plate (23) are turned around by the function of the irises (29) provided at the end portion of the slot-array antenna and are successively radiated to the outer space (within the vacuum-dryer tank) from the slot (24), like the progressing waves. The microwaves which have jumped into the slot-array antenna from the outer space are also subjected to the function of the irises (29) to be re-radiated to the outer space.

Stubs can be used in place of the irises (29).

In this manner, the fact that the radiation impedances of the respective slots are of the same value characteristics while blocking up reflection waves at the portion of the single circuit of each slot-array antenna, will thus cause the microwaves to be radiated to the outer space passing through the slots at the rate of substantially equal electric power ratios.

It has hereinbefore been mentioned that electric discharging is blocked up by maintaining the interior of a series of the transmission pipe circuit at the atmospheric pressure where the electrical field intensity for initiation of electric discharge is high. Another inventive effort resides in the other fact that the primary and secondary branching waveguides are connected each other by means of the slot-type junction so that radiation of equal-electric-power may be effected.

The locations where directional components of swirling electric currents flowing in the broad-width guide wall surfaces of the rectangular waveguide as used in this embodiment get to be equal, are arranged to assume an appearance like as steppingstones located at intervals equal to the wave-length of the transmitted wave within the pipe.

Figure 4:
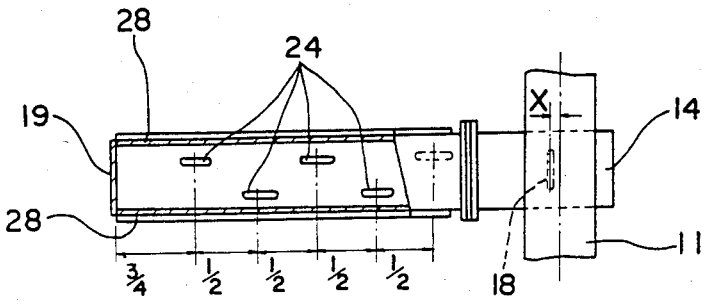
FIG. 4 is a plan view of a slot-array antenna with a portion cut away.

In this embodiment of the invention, the secondary branching waveguides (14) to (17) juxtaposedly connected in right angle to the primary waveguide (11) are at the distance $l_f$ equal to the wave-length of the transmitted wave within the guide. In the protion of the electrical connection between the primary and secondary branching waveguides, a slot is provided, at the point that is spaced apart from the center line of the primary branching waveguide (11) a certain predetermined distance x as shown in FIG. 4. The connection slot is oriented in parallel to the center line of the branching waveguide and has a length of $\frac{1}{2}\lambda_g$.

A certain normalized conductance $\widetilde{G}o$ per each slot is unpolysemously defined by the transmission theory in accordance with the number of the secondary branching waveguides.

On the other hand, the actual normalized conductance G of the secondary branching waveguide (14) connected to the primary branching waveguide (11) with its righthand end short-circuited as shown in FIG. 4 will vary complexly in accordance with the short-circuiting distance of the secondary branching waveguide (14) and the 2-dimensional location of the slot (18). In view hereof, the distance x is expeimentally determined in this embodiment so that the normalized conductance $\widetilde{G}$ defined by the 2-dimentional location of the slot (18) may come to be $\widetilde{G}o \simeq \widetilde{G}$, to thus establish the optimal connection by the slot.

In the branching waveguide circuit in which all the normalized conductances $\widetilde{G}$ of the respective slots possess the same value, the microwave electric power which is transmitted to the primary branching waveguide (11) is then transferred to the secondary branching waveguides (14) to (17) at the equal ratio of electric power and in the state of the equal phase.

In the other aspect, it is necessary that the electric power passing through the slot (18) for the connection affords the electric power to be supplied to the slot-array antennas which are connected to the secondary branching waveguide.

The necessary electric power, when evaluated under the aforementioned normal conditions, may be about 150 watts for one single slot-array antenna.

If such large electric power should be transmitted under such a reduced pressure as in the known freeze-drying process, the electric field intensity exerted to the single slot of the electric wave radiation would become extremely high far beyond the discharge initiation intensity of electrical field and thus electric discharging would occur as a matter of course at such location.

However as mentioned hereinbefore the blocking plates (23) are sandwitched between the slot-array antennas and the secondary branching waveguides, in such a manner that said plates constitute the closed type resonator apparatuses (R) integral with the slot-array antennas to thereby keep the resonator airtight to maintain atmosphenic pressure within, the waveguide circuit interior leading to the slot-array antennas. The necessary and sufficient microwave electric power is thus transmitted while avoiding any electric discharge under such a structure that can retain the discharge initiation intensity of electrical field on a high level.

Now, the function and effect of the above apparatus will be described in vacuum-freeze-drying the frozen foods.

The foods or the like that are frozen beforehand are put into the recipient trays (30). The trays are then put on the transferring-holder (31), which in turn is transferred into the vacuum-dryer tank, its door being closed thereafter.

After evacuation of the vacuum-dryer tank to a pressure near the operational pressure of the freeze-drying, the heating medium such as hot air, steam, heating oil or the like is then circulated within the circulation pipes (25) by means of a heating control apparatus (not shown) so as to obtain an optimum temperature pattern for radiator-heating operation. By this operation, the heat-ipes (27) provided on both sides of the slot-array antennas via the heat-transmission-relaying bodies (26) are heated to heat the slot-array antennas (19) to (22) substantially to a temperature of the heating medium so that the slot-array antennas (19) to (22) themselves may function as the heat radiators.

Here, with the temperature difference between the slot array antenna and the goods to be heated (both the frozen foods and the recipient trays) functioning as the motive power of the heat transfer, neat travels to surfaces of the goods to sublimingly dry same, that have been in the frozen state, wherein heat radiation plays a dominant roll in the heat transmission.

On the other hand, microwave electric powers emitted by the microwave oscillators (4) to (6) are transmitted from the main waveguides (1) to (3) disposed outside the tank) through the respective T-shaped branching pipes (8) to (10) into the primary branching waveguides (11) to (13) connected thereto on the lefthand and righthand sides, at the equal splitting ratio of ½. Thus, for instance in case where microwave energy having a power of unit i.e. (1) is supplied to the T-shaped branching pipe (8) a microwave energy having half a unit power i.e. ½ is transmitted to each first branching waveguide (11).

Microwave electric power fed to the primary branching waveguide will then be divided into branches of the same phase and the same power by virtue of the function of the slots (18) provided at the connecting portions between the primary and secondary branching waveguides, and is thus transmitted through the respective blocking plates (23) between the second branching waveguides and the closed type resonators (R) finally into the slot-array antennas (19) to (22) whereby the microwaves are radiated from a plurality of the slots (24) towards the goods to be heated, under the condition of the good inherent directivity and as well as the homogeneous distribution.

Majority of the microwaves radiated from the slots (24) travel stright in the free space so as to be penetrate into deep portions of the foods to thereby be consumed as absorption heat within the foods while being repeatedly relfected or refracted at the boundary surfaces of the foods or the recipient trays.

Microwaves that have not been consumed within the foods form up higher modes within the free space wherein a 3-dimensional transmission takes place to cause said residual microwaves to be transferred to the various electro-conductive walls within the vacuum-dryer tank or to the foods or the like while being consumed as heat energy.

If the waveguide circuit is supplied with an electric power the level of which exceeds that of such microwave electric power as consumed under the load, the reflection waves as well as the electric field intensity will increase in general to thus excite initial electrons and initial ions existing in the interveing gas which are likely to induce electric discharging.

Accordingly, there is provided in the embodiment a photosensor means (not shown) adapted to detect the electric discharging which will occur due to the action of the excessively high power of microwave fed to the apparatus. Thus the input level of the microwave electric power can be controlled to an optimum level in accordance with the actual load so that an efficient freeze-drying operation may always be guaranteed.

In the known or conventional freeze-drying process utilizing radiator or conduction heating system, the drying proceeds in such a manner that water content of the foods decreases to some degree thereby forming a dried layer or outer surface which is resistant to the heat transmission resulting in a drastically reduced drying rate. It has therefore been necessary to continue the operation for quite a long time in order to seek a slight reduction of the water content.

However, with the composite apparatus of the embodiment provided with the radiation heating and the microwave heating systems, a remarkable shortening of the drying time as well as a better homogenization of the heating and drying are now afforded advantageously by either effecting the initial operation depending only upon the radiator heating system so as to operate the microwave heating system in a compound way from the period when the drying speed just begins to be decelerated or by operating both the heating systems in a compound way from the beginning of the operation. As a result hereof, proof is obtained which demonstrates a higher productivity and a lower drying cost.

It is also to be noted that since the slot-array antennas serve dually as the microwave emitter and as the heat radiator radiator heating, it is possible to make the apparatus more compact in comparison with the case a heat radiator is simply added to the apparatus.

Despite the exemplified arrangement in which the blocking plate (23) is positioned at the inlet end of the slot-array antenna, to constitutes the closed type resonator (R) together with the slot-array antenna, this location of the plate can of course be altered arbitrarily.

However, this location is advantageous in manufacturing and in obtaining a good function of the apparatus.

Besides, it is also possible to give to the slots (24) a shape of slits extending in the direction of microwaves without arranging the slots to form the shape like as steppingstones.

Figure 8:
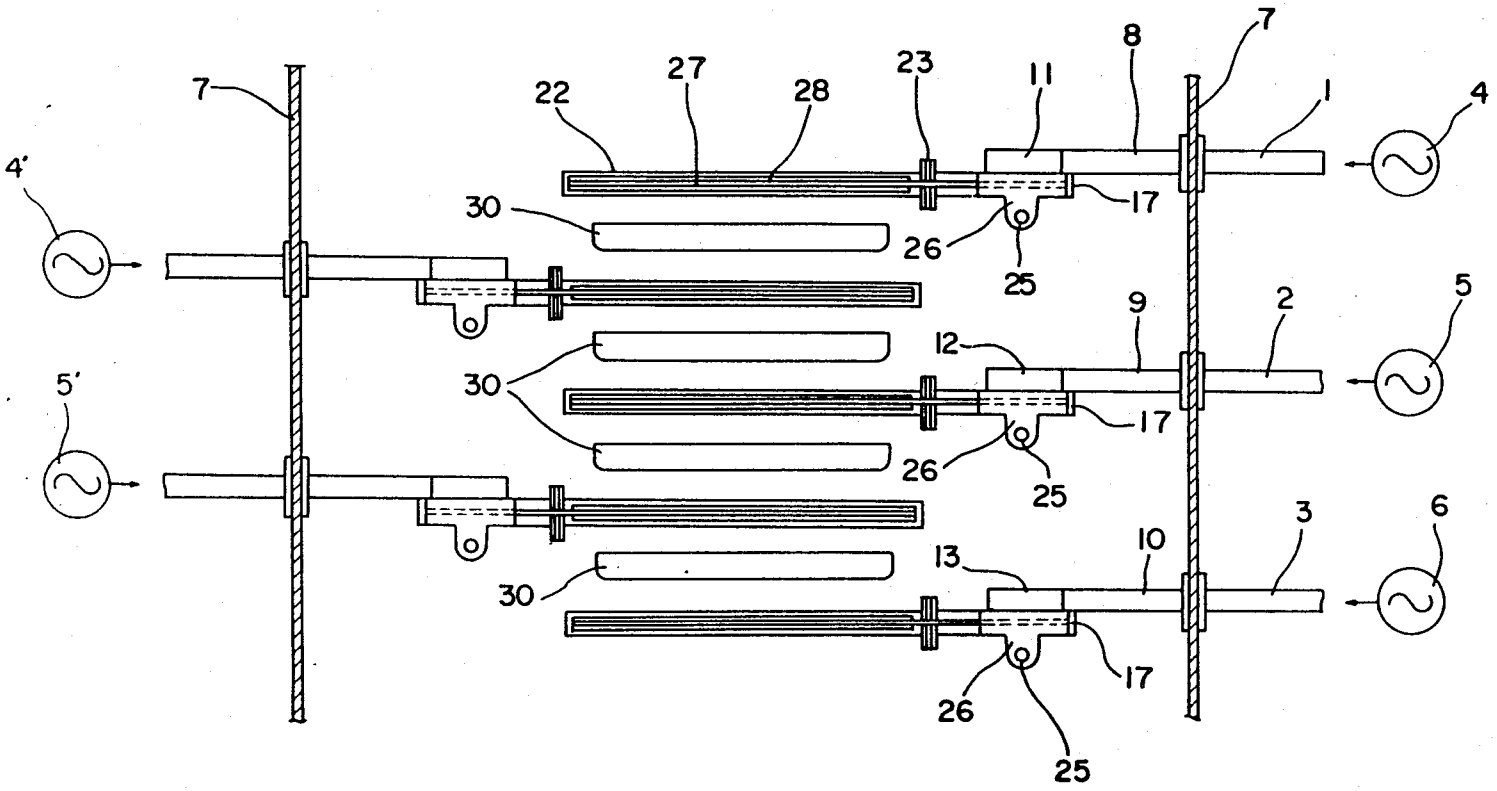
FIG. 8 is a front view a different embodiment, with its portion shown in vertical section.

Furthermore, though both the microwave and radiator heating systems are disposed on one side of the transferring-holder (31) the slot-array antennas may be located in a manner such that they alternately extend toward each other in opposite directions as shown in FIG. 8.

Besides, though the T-shaped branching waveguides, the primary and secondary branching waveguides as well as the slot-array antennas are disposed within the vacuum-dryer thank in the embodiment, it may be modified to protrude only the slot-array antennas into the vacuum-dryer tank.

INDUSTRIAL APPLICABILITY

As above, the dryer apparatus according to this invention is widely available on a commercial scale to the vacuum-freeze drying and to the vacuum drying of the foods, pharmaceuticals and the like, and more particularly to the vacuum-freeze-drying of the frozen foods.

We claim:

1. A microwave vacuum dryer apparatus comprising, a vacuum drying tank, slot-array antenna means disposed in said vacuum drying tank, microwave generating means disposed outwardly of said vacuum drying tank and under ambient pressure, waveguide means leading from said microwave generating means to said slot-array antenna means, and blocking plates mounted between said microwave generating means and said slot-array antenna means, said blocking plates each comprising a window formed of a material permitting easy passage of microwaves and a metal window frame, said window having a strength to withstand a differential pressure between a vacuum in said vacuum drying tank and the ambient pressure outside thereof, said metal window frame being disposed between the waveguide means and the antenna means, and further comprising at lest two irises, each iris provided an an end portion of the slot-array antenna in such a manner that reflected waves from the short-circuit wall and the window frame of the blocking plate are reflected by the irises so as to advance forward again into the antenna; wherein said window, said metal window frame and said slot-array antenna means operate to set up a closed type resonator.

2. The dryer apparatus of claim 1, characterized in that the window is made of borosilicate glass.

3. The dryer apparatus of claim 2, wherein the slot-array antenna comprises slots arranged therein at suitable intervals so as to form a steppingstone-like shape.

4. The dryer apparatus of claim 2, wherein the slot-array antennas are located to have a configuration such as come-teeth.

5. The dryer apparatus of claim 2, wherein the heating apparatus comprise heat pipes.

6. The dryer apparatus of claim 5, characterized in that the heat pipes are fixedly fitted in protrusion grooves provided on the outer surfaces of the slot-array antennas.

7. A method for microwave vacuum drying comprising the steps of:

maintaining a vacuum drying tank in a relative vacuum state to facilitate drying;

maintaining waveguides leading to the vacuum dryer at a higher pressure than that in the vacuum drying tank to minimize electrical discharge from the waveguides;

minimizing microwave discharge by setting up a closed-type resonator, having a glass window and a metal window frame, the metal window frame being disposed between the waveguide and an antenna means, transmitting microwaves from the antenna means along the waveguides into the vacuum drying tank to dry material in the drying tank, and providing a plurality of irises to reflect microwave from the direction of the antenna means back toward the antenna means.

* * * * *